US005873663A

United States Patent [19]

Yokoi et al.

[11] Patent Number: 5,873,663

[45] Date of Patent: Feb. 23, 1999

[54] PRINTING APPARATUS AND PRINTING METHOD THEREOF

[75] Inventors: Katsuyuki Yokoi, Yokohama; Masafumi Wataya, Kawasaki, both of Japan

[73] Assignee: Canon Kabushiki Kaisha, Tokyo, Japan

[21] Appl. No.: 878,130

[22] Filed: Jun. 18, 1997

Related U.S. Application Data

[63] Continuation of Ser. No. 274,794, Jul. 14, 1994, abandoned.

[30] Foreign Application Priority Data

Jul. 15, 1993 [JP] Japan ..... 5-175148

[51] Int. Cl.[6] ..... B41J 19/30

[52] U.S. Cl. ..... 400/279; 400/120.05; 400/320

[58] Field of Search ..... 400/88, 279, 120.05, 400/120.06, 320, 322, 323; 347/180, 182

[56] References Cited

U.S. PATENT DOCUMENTS

| | | | |
|---|---|---|---|
| 4,305,674 | 12/1981 | Velazquez | 400/320 |
| 4,421,431 | 12/1983 | Dorrfub | 400/124.04 |
| 4,738,553 | 4/1988 | Uemura et al. | 400/120.05 |
| 4,750,049 | 6/1988 | Murakami et al. | 400/88 |
| 4,877,343 | 10/1989 | Hori | 400/124.04 |
| 4,933,867 | 6/1990 | Ishigaki | 400/88 |
| 5,112,149 | 5/1992 | Suenaga | 400/88 |
| 5,189,436 | 2/1993 | Yoshikawa | 400/322 |
| 5,191,356 | 3/1993 | Shibamiya | 400/124.04 |
| 5,263,994 | 11/1993 | Ueda | 400/157.3 |
| 5,312,193 | 5/1994 | Kringe | 400/124.04 |
| 5,539,433 | 7/1996 | Kawai et al. | 347/182 |

FOREIGN PATENT DOCUMENTS

| | | | |
|---|---|---|---|
| 0300823 | 1/1989 | European Pat. Off. | 400/279 |
| 0390125 | 10/1990 | European Pat. Off. | 400/279 |
| 0491957 | 7/1992 | European Pat. Off. | 400/279 |
| 0551014 | 7/1993 | European Pat. Off. | 400/279 |
| 58-205778 | 11/1983 | Japan | 400/279 |
| 59-045166 | 3/1984 | Japan | 400/279 |
| 59-155083 | 9/1984 | Japan | 400/279 |
| 61-211050 | 9/1986 | Japan | 400/279 |
| 2171268 | 7/1990 | Japan | 400/279 |

*Primary Examiner*—John Hilten
*Assistant Examiner*—Steven S Kelley
*Attorney, Agent, or Firm*—Fitzpatrick, Cella, Harper & Scinto

[57] ABSTRACT

A printing apparatus capable of printing by moving a carriage mounting a printing head to a recording paper detects a movement of the carriage for a predetermined distance by an encoder, clocks the time for the carriage to move in the distance, and obtains the moving speed of the carriage in accordance with the clocked time. Time intervals for printing by the printing head are determined by the carriage moving speed, and a printing is performed at a constant printing density in an acceleration/deceleration area in addition to the area where the carriage is moving at a constant speed.

7 Claims, 16 Drawing Sheets

113
COMMON1
116
COMMON2
117
COMMON8
106
J
CK Q
K
104
105
DO 7
RC
LD
CK
102
103
112
DO 7
QO 7
CK
8
107
DATA
108
LATCH1
109
LATCH1
CLK
LOAD
110
111
DATA
LATCH
CLK
LOAD
114
115
101
CPU
101a
ROM
TABLE
101b
121
VDATA
ENB
123
CLK
122
119
303
HEAT TRIGGER SIGNAL GENERATING UNIT
ENCODER
118
702
120
CARRIAGE MOVING SPEED DETECTOR 301
302
303
304
305
306
307
308
309
T1
T2
T3
T4
1
2
3
4
5
6
7
8
FIG. 11A HEAT TRIGGER SIGNAL
FIG. 11B COMMON1
FIG. 11C COMMON2
FIG. 11D COMMON8
FIG. 11E SEGMENT1
FIG. 11F SEGMENT2
FIG. 11G SEGMENT8

PRINTING APPARATUS AND PRINTING METHOD THEREOF

This application is a continuation of application Ser. No. 08/274,794 filed Jul. 14, 1994, now abandoned.

BACKGROUND OF THE INVENTION

The present invention relates to a printing apparatus and printing method which moves a printing head to a printing medium.

Conventionally, in a serial-type printer which performs printing by scanning a printing head in the main scanning direction, and by moving a recording medium such as a recording paper in the sub-scanning direction, printing is performed by moving a carriage mounting the printing head by a carriage motor. In this case, the printing is performed in synchronism with the moving of the carriage while a position of the carriage is being detected by an encoder. FIG. 8 is a diagram showing the position relationship between the printing area of the printing apparatus and the carriage moving range in the main scanning direction (speed, range in the main scanning direction). In the printing area, the carriage moves at a constant speed in the printing area, and an acceleration area and deceleration area are respectively provided before and after the printing area for acceleration and deceleration based on the characteristic of the carriage motor.

Accordingly, in the conventional printer apparatus, since the acceleration/deceleration area needs to be provided on the both sides of the printing area, the total scanning distance of the carriage in the main scanning direction becomes longer than the length in the printing area. Accordingly, a problem arises in that the apparatus become large in size. Particularly, in a color printing apparatus having a plurality of printing heads in the main scanning direction and a cartridge containing ink used for printing, not only the moving distance of the carriage becomes longer, but also the acceleration area to accelerate the carriage speed to a predetermined speed and the deceleration area to decelerate and suspend the carriage movement need to be longer due to the increase of the carriage weight. Accordingly, the length of the carriage scanning direction becomes longer, and this is a main problem in minimizing the entire apparatus in size.

SUMMARY OF THE INVENTION

Accordingly, in the light of the above problems, it is an object of the present invention to provide a printing apparatus which is minimized in size and a printing method capable of printing by a printing head in an area out of the area where the printing head moves at a constant speed.

It is another object of the present invention to provide a printing apparatus and method capable of performing a high-quality printing in the acceleration/deceleration area of the printing head, as well as in the constant speed area.

Furthermore, it is another object of the present invention to perform printing dots at an interval which is shorter than the interval capable of detecting a movement of the printing head.

Still further, it is another object of the present invention to provide a printing apparatus and method capable of performing printing at a constant dot pitch in an area out of the area where the carriage motor is being rotated at a predetermined rate.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated and constitute a part of the specification, illustrate embodiments of the invention and, together with the description, serve to explain the principles of the invention.

DESCRIPTION OF THE PREFERRED EMBODIMENTS

Preferred embodiments of the present invention will now be described in detail in accordance with the accompanying drawings.

Figure 2:
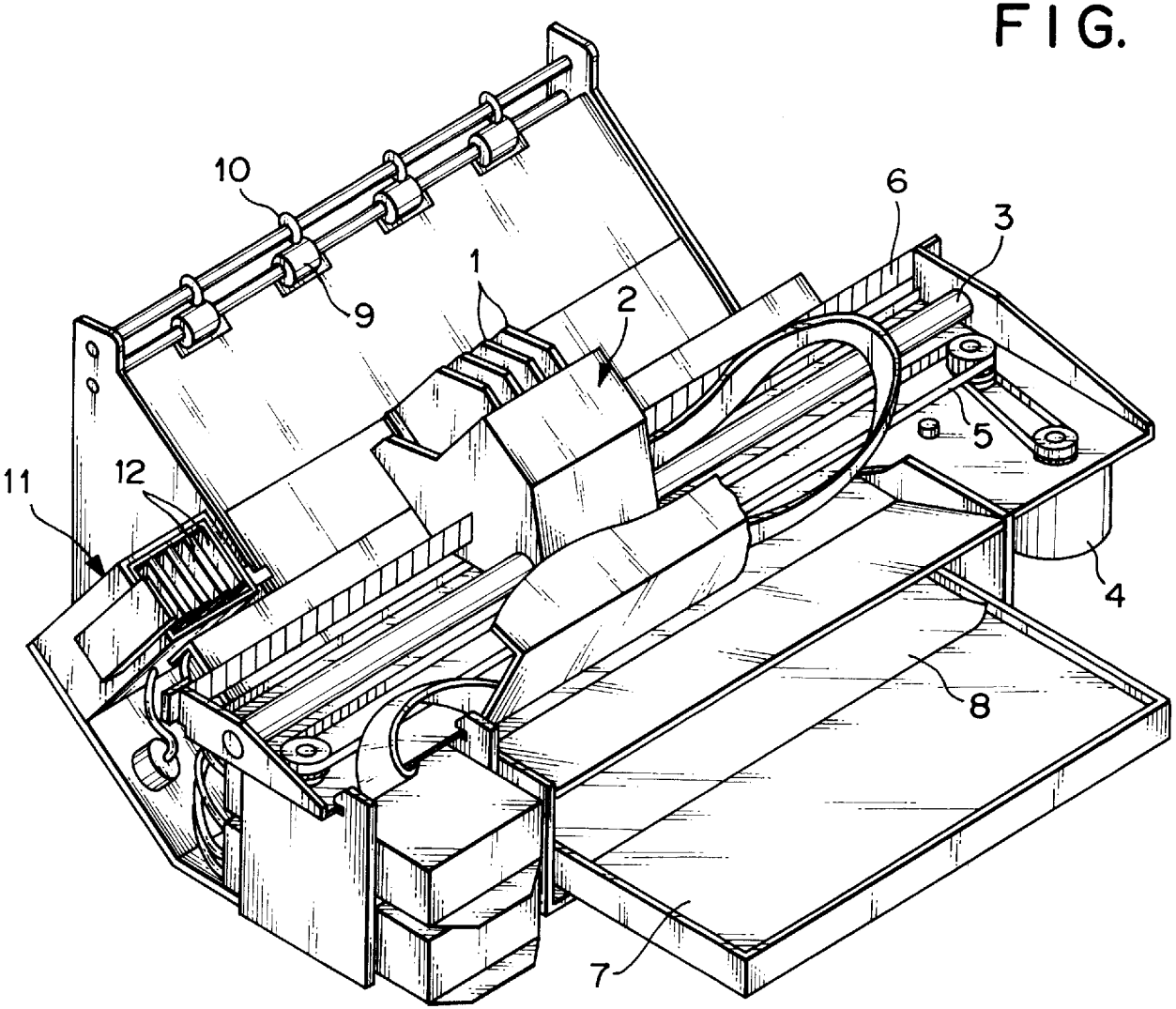
FIG. 2 is an external view of the main portions of the ink-jet printer of the embodiment.

FIG. 2 is an external view of the serial-type inkjet printer of the embodiment.

In FIG. 2, numeral 1 is an ink-jet head having a single nozzle or a plurality of nozzles which discharges ink droplets. The ink-jet head 1 is mounted on a carriage 2, and performs printing on a recording medium such as a recording paper. The carriage 2 scans in the main scanning direction. Numeral 3 is a carriage shaft which serves as a guide when the carriage 2 scans in the main scanning direction. Numeral 4 is a carriage motor which makes the carriage 2 reciprocate in the main scanning direction by the rotation. Numeral 5 is a carriage belt, a part of which is fixed on the carriage 2, which moves the carriage 2 by rotation of the carriage motor 4. Numeral 6 is an encoder film which detects the position of the carriage 2 (to be described later), and is used to set a print timing of the ink-jet head 1. Numeral 7 is a paper feeding cassette which contains a recording medium 8 such as a paper. Numeral 9 is a paper ejecting roller, numeral 10 is a driven roller, and numeral 11 is a maintaining unit of the inkjet head 1 which caps the head, wipes an ink-jet discharging surface of the head, and recovers the head. Numeral 12 is a head cap which prevents ink from drying out by closing the nozzle of the ink-jet head 1 by capping.

With the above structure, when a printing operation is started, the recording medium 8 is picked up from the paper feeding cassette 7 by the paper feeding roller (not shown), and transferred to a predetermined print start position. Subsequently, the carriage 2 is moved in the main scanning direction by the rotation of the carriage motor 4, and then the printing is started. At this time, a slit on the encoder film 6 is read by the encoder sensor 20 (refer to FIG. 1) which is mounted on the carriage 2, thus the print timing of the ink-jet head 1 is obtained.

Figure 1:
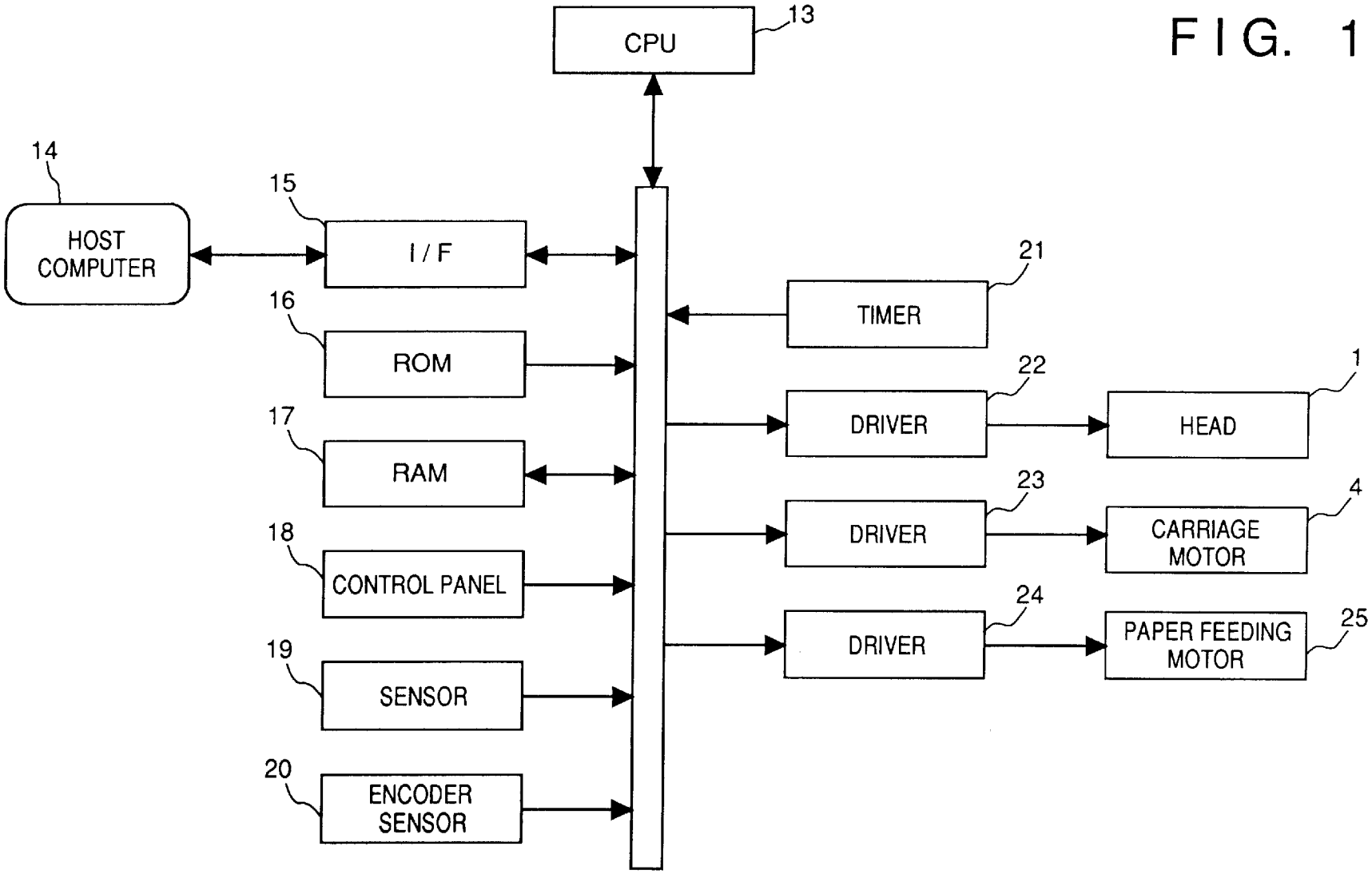
FIG. 1 is block diagram illustrating the general construction of an ink-jet printer of the first embodiment of the invention.

FIG. 1 is a block diagram illustrating the control circuit of the ink-jet printer of the embodiment.

In FIG. 1, a central processing unit CPU 13 such as a microprocessor which is connected to a host computer 14 via an interface (I/F) 15 controls a printing operation based on the recording (printing) data stored in a buffer memory such as RAM 17 according to the controlled program stored in a ROM 16. The CPU 13 also controls the rotation of the carriage motor 4 and a paper feeding (LF) motor 25 via motor drivers 23 and 24, and drives the printing head 1 via the head driver 22 based on the printing data stored in the RAM 17. Numeral 18 is a control panel by which an operator sets various modes or confirms the printing state of the printer. Numeral 19 is a sensor for detecting whether or not a recording medium exists, and numeral 20 is an encoder sensor mounted on the carriage 2 for detecting slits of the encoder film 6. Furthermore, numeral 21 is a timer for clocking the predetermined period which is instructed by the CPU 13.

Figure 3A:
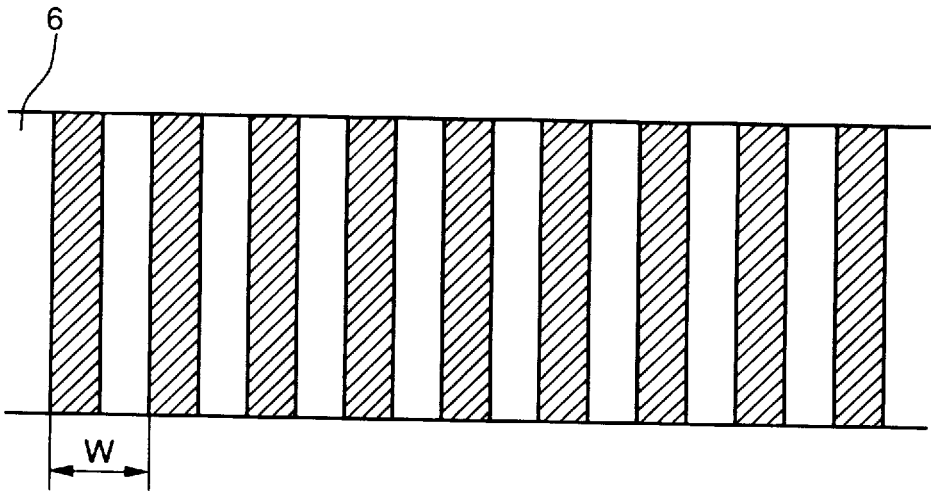
FIGS. 3A and 3B are diagrams showing the relationship between the slits of an encoder film and dots to be printed.
Figure 3B:
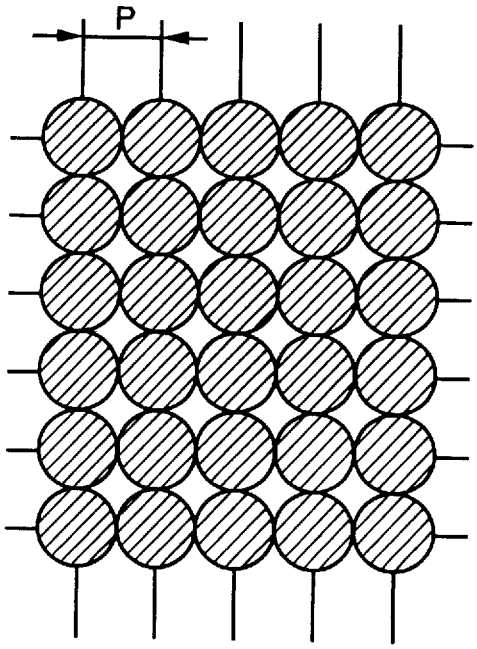

FIGS. 3A and 3B are model diagrams showing the relationship between the slits of the encoder film 6 and the head 1. FIG. 3A shows the slits of the encoder film 6, and FIG. 3B shows dots printed by the ink-jet head 1.

As an improvement of printing quality, a dot interval P (FIG. 3B) is shortened, while the slit interval W of the encoder film 6 (FIG. 3A) cannot be shortened due to the condition in producing the encoder film 6. The slit interval W is set to a distance corresponding to the dot interval P multiplied by an integer. In FIGS. 3A and 3B, the case of W=2P is shown.

Figure 4:
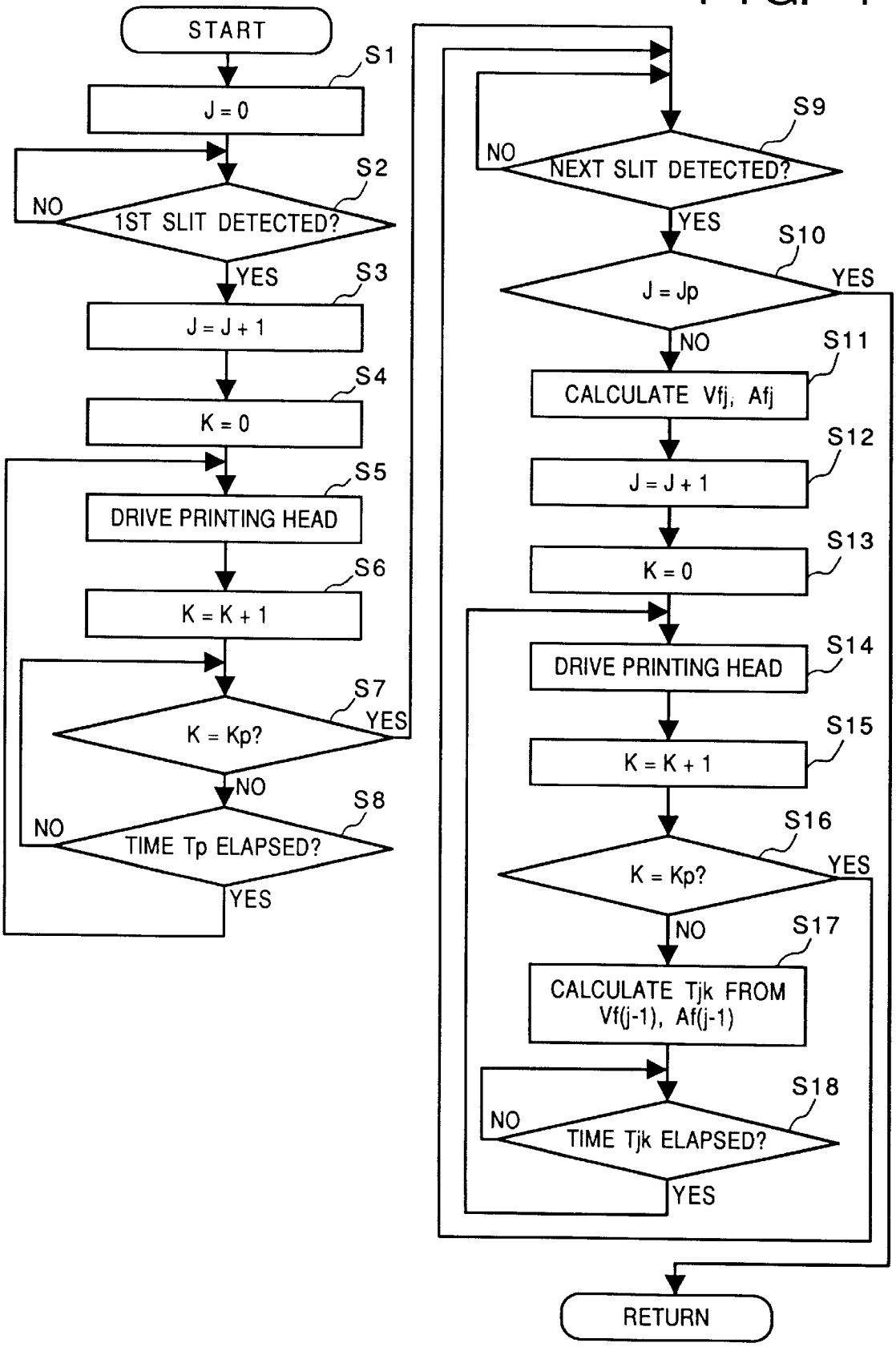
FIG. 4 is a flowchart illustrating the printing processing in the ink-jet printer of the embodiment.
Figure 5:
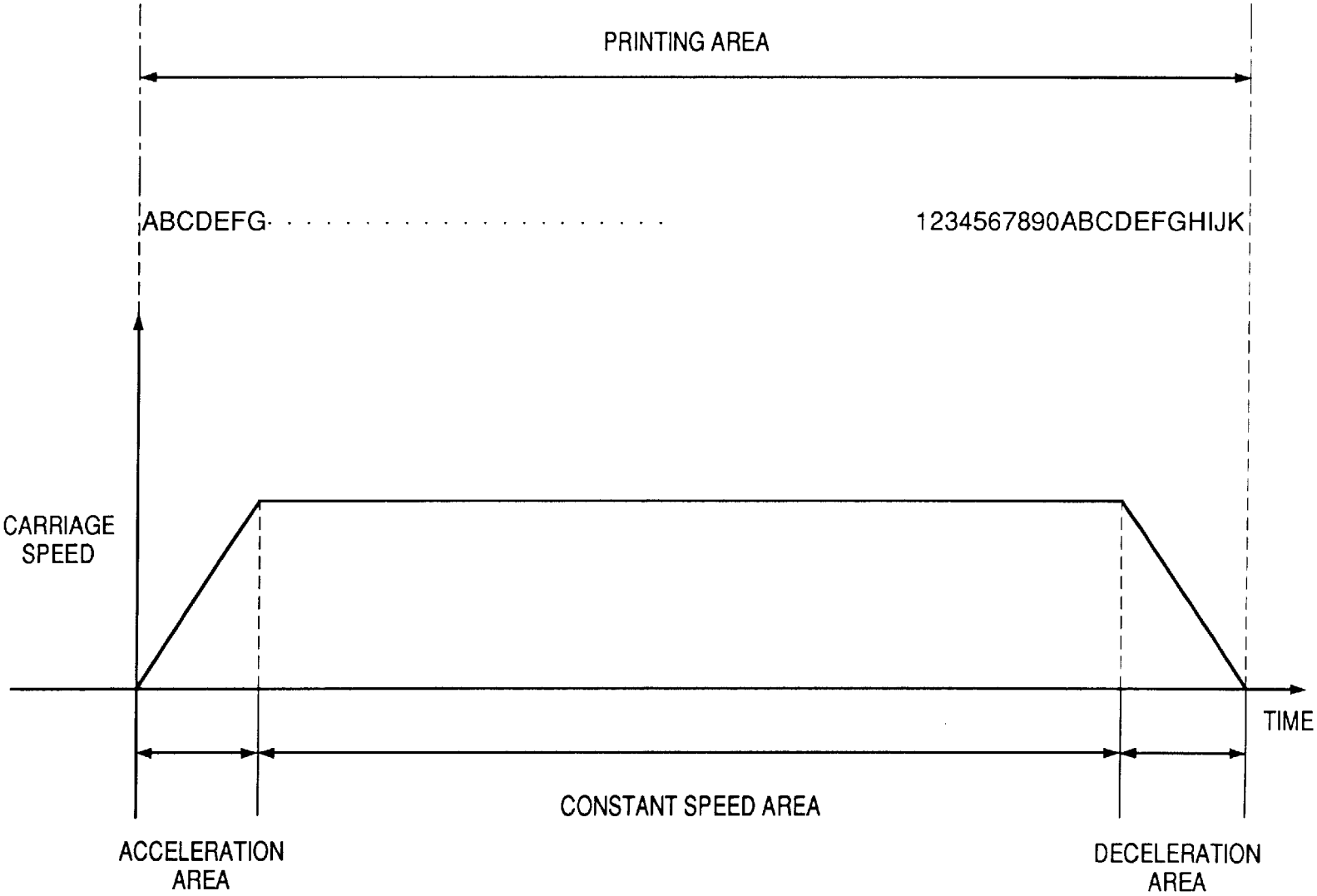
FIG. 5 is a diagram showing the relationship between the printing area and the carriage speed in the embodiment.

FIG. 4 is a flowchart illustrating the printing operation in the ink-jet printer of the embodiment. The control program which executes this processing is stored in the ROM 16. FIG. 5 is a diagram showing the relationship between the printing area and the position of the carriage 2 in the main scanning when the flowchart of FIG. 4 is executed. As apparent from the figure, printing can be performed in the acceleration/deceleration area as well as in the constant speed area.

The processing of FIG. 4 is started by the start instruction of the printing operation. First, at step S1, the counter J (provided in the RAM 17) which counts the number of slits of the encoder film 6 detected in the printing area is cleared as "0". At step S2, the scanning of the carriage 2 is started by starting the rotation of the carriage motor 4. When the encoder sensor 20 mounted on the carriage 2 detects the first slit of the printing area (refer to FIG. 5), the process proceeds to step S3 where the counter J is incremented by one. At step S4, the counter K (provided in the RAM 17) is set to "0", and at step S5, the printing head 1 is driven to print. Subsequently, while the carriage motor 4 is rotated and driven to make the carriage 2 scan in the main scanning direction, the counter K is incremented by one at step S6, and whether or not "K" is equal to "Kp" is determined at step S7. At step S8, when a predetermined time Tp has elapsed, the process returns to step S5 where the head 1 is driven to print. The time measurement of the predetermined time Tp at step S8 is performed by the timer 21. The predetermined time Tp is a time which is empirically obtained from the dot pitch to be printed and the carriage speed immediately after the carriage motor 4 is started.

Accordingly, at step S7, when the printing is performed for the predetermined number of times Kp (which is determined based on the slit pitch of the encoder film 6 and the dot pitch to be printed; Kp=2 in the case of FIGS. 3A and 3B), the process proceeds to step S9 where it is waited for the encoder sensor 20 to detect the next slit. When the next slit is detected at step S9, the process proceeds to steps S10 and S11 where the carriage moving speed Vfj and the acceleration Afj are calculated from both the time when the previous slit is detected and the time when the current slit is detected. Subsequently, the process proceeds to step S12 where the counter j is incremented by one. At steps S13–S16, the head 1 is driven in a similar manner to the steps S4–S7.

Subsequently, the process proceeds to step S17 where the time Tjk required for the carriage 2 to move a dot pitch to be printed is calculated from the previously obtained carriage moving speed Vfj and acceleration Afj. At step S18, when the time Tjk is elapsed from the previous print timing, the process returns to step S14 where the next dot is printed. The steps S14–S18 are repeated for the number of times designated by "Kp". In the example of FIGS. 3A and 3B, when two dots are printed between slits at Kp=2, the process returns to step S9 where it is waited for the next slit to be detected. At step S10, when the Jp-th slit in the printing area is detected, it is determined that the printing area is ended, and the printing ends (the length of the printing area is corresponding to the Jp slits of the encoder film 6).

Figure 8:
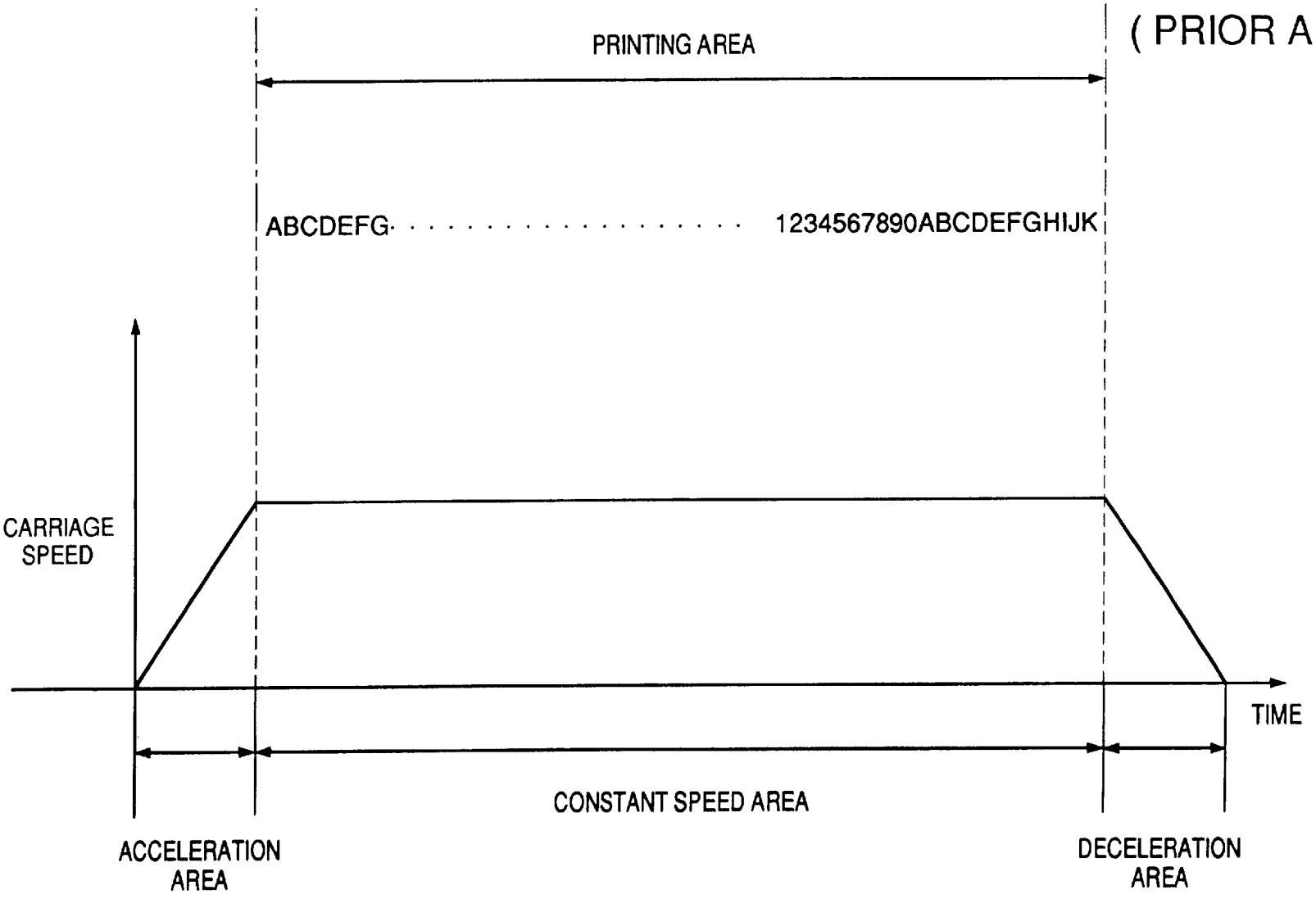
FIG. 8 (PRIOR ART)
FIG. 8 is a diagram showing the relationship between the printing area and the carriage speed in a conventional printing apparatus.

As described above, an excellent printing result in which the dot pitch is constant can be obtained in the acceleration/deceleration area of the carriage 2 (carriage motor 4) as well as in the constant speed area. Accordingly, printing can also be performed in the acceleration/deceleration area on the both sides of the constant speed area, and the length in main scanning direction can be shortened to obtain the same printing length (refer to FIG. 8). As a result, a compact printing apparatus capable of high-quality printing can be provided.

Figure 6:
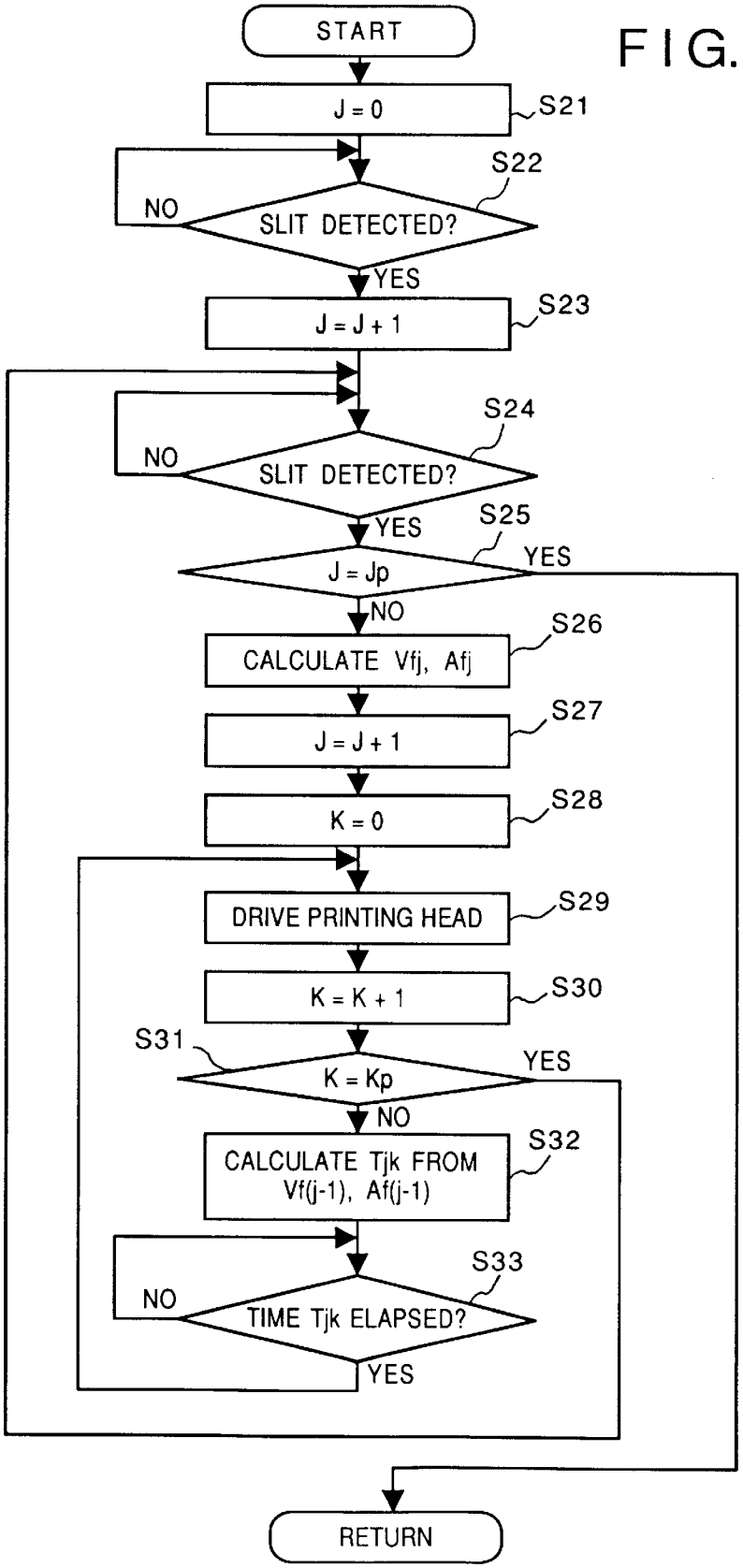
FIG. 6 is a flowchart illustrating the printing process of the second embodiment of the invention.

FIG. 6 is a flowchart illustrating the process when the encoder film having at least a single slit (used to determine a scanning speed of the carriage 1) before and after (in the case of printing in the reverse direction) the printing area, besides the slits in the printing area is used.

In FIG. 6, when the carriage motor 4 is rotated and the carriage 2 is moved forward, the slit before the printing area of the encoder film 6 is detected at step S22, the time (measured by the timer 21) when the slit is detected is stored. Subsequently, when the carriage motor 4 is driven to make the carriage 2 scan in the main scanning direction, the first slit of the printing area is detected at step S24. In step S25, it is determined whether or not the printing area has ended (J=Jp). If not, the process proceeds to step S26 where the carriage moving speed Vfj and acceleration Afj are obtained from the difference between the time when the previous slit is detected and the time when the current slit is detected.

The first driving timing of the head 1 is determined from the timing that the slit is detected at step S24, and later, the time Tjk required to move the carriage 2 for the dot pitch is calculated (step S32). When the time Tjk has elapsed from the previous print timing, the process proceeds from the step S33 to step S29 where the next print timing is obtained. When the steps S29–S33 are repeated for the predetermined number of times Kp, the process returns to step S24 where the next slit is detected, and the printing process of steps S29–S33 is repeated. This printing process is repeated until the Jp-th slit indicating the end of the printing area is detected. The values Kp and Jp in the flowchart of FIG. 6 are equivalent to the values in the flowchart of FIG. 4.

As described above, according to the second embodiment, in the acceleration/deceleration period of the carriage 2 (carriage motor 4), even if the carriage 2 is not scanning in the main scanning direction at the constant speed, since the dot pitch can be controlled so as to be constant, excellent printing result is obtained. Accordingly, the area where printing is avoided to accelerate/decelerate the carriage 2 is not needed at the both sides of the constant speed area. Thus, the printing area which is the same distance as the original printing area can be reserved, even if the carriage scanning area in the main scanning direction is shortened.

Figure 7:
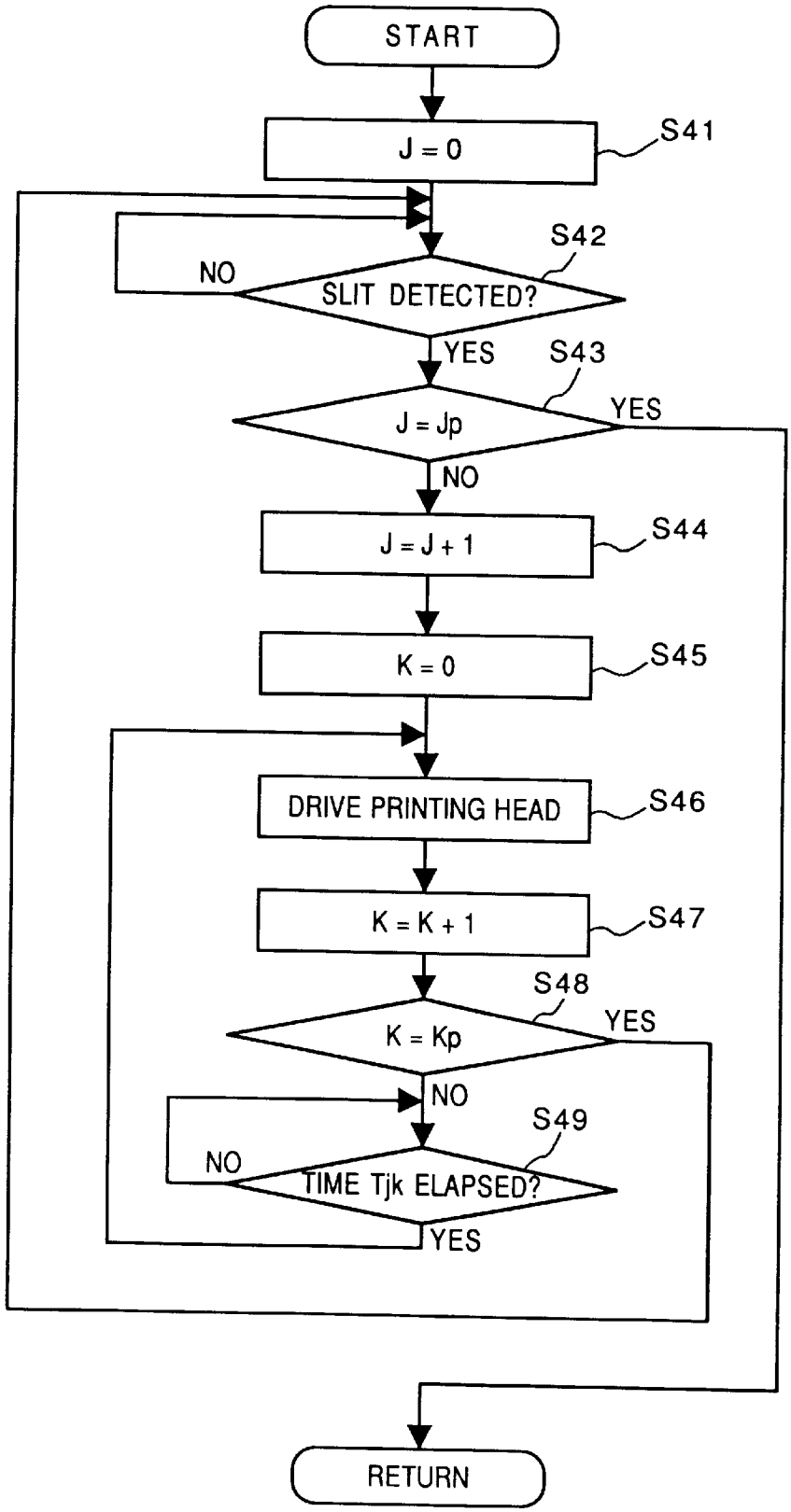
FIG. 7 is a flowchart illustrating the printing process of the third embodiment of the invention.

FIG. 7 is a flowchart illustrating the operation of the third embodiment of the invention. In this embodiment, a head driving timing is not obtained by calculating the carriage speed by a detection signal of the encoder sensor 20, but from the data which is empirically obtained and stored in a table.

The operation of FIG. 7 is described below. Since the counters J and K and predetermined values Jp and Kp have the same meaning of those in the first embodiment, the description is not needed. After the carriage motor 4 is driven, when the first slit of the printing area is detected at step S42, this timing is used as a driving timing of the head 1, and the head 1 is driven to print at step S46. Subsequently, the carriage motor 4 is rotated and driven to move the carriage 2 in the main scanning direction, and at step S49, whether or not the predetermined time Tjk has elapsed from the previous printing timing is determined.

The predetermined time Tjk is obtained from the relationship between the scanning speed Vcj of the carriage 2 in the main scanning direction by the rotation/drive of the carriage motor 4 and the dot pitch P to be printed. Accordingly, time values empirically obtained from the relationship between the scanning speed Vcj and the dot pitch P are stored in the RAM 17 or ROM 16 as a table. At step S49, the time Tjk is obtained from the relationship between the carriage speed and dot pitch P with reference to the table, and it is waited until the obtained time Tjk is elapsed. When elapsed, the process proceeds to step S46 where the next dot is printed. When the next slit is detected at step S42 after Kp dots are printed at the interval of slit and the next slit in this manner, the head 1 is driven to perform printing. Again, at step S49, the time Tjk is obtained, and the next print timing is obtained. This process is repeated until the final Jp-th slit of the printing area is detected at step S43.

In the third embodiment, the dot pitch is controlled to be constant during the acceleration/deceleration of the carriage (carriage motor 4), and thus, an excellent printing result can be obtained for the printing area which has a constant speed area and acceleration/deceleration area of the carriage. Accordingly, an entire printer can be minimized in size.

Furthermore, in the above embodiments, the case where the driving timing of the printing head 1 is synchronized with the detection of a slit of the encoder 6 is described, however, this does not impose a limitation upon the invention. For example, in the case of a printer without the encoder, a stepping motor is used as the carriage motor 4, the positions of the carriage 2 are determined based on the number of driving pulses, and the printing head 1 can be driven in synchronism with the movement of the carriage 2.

Figure 9:
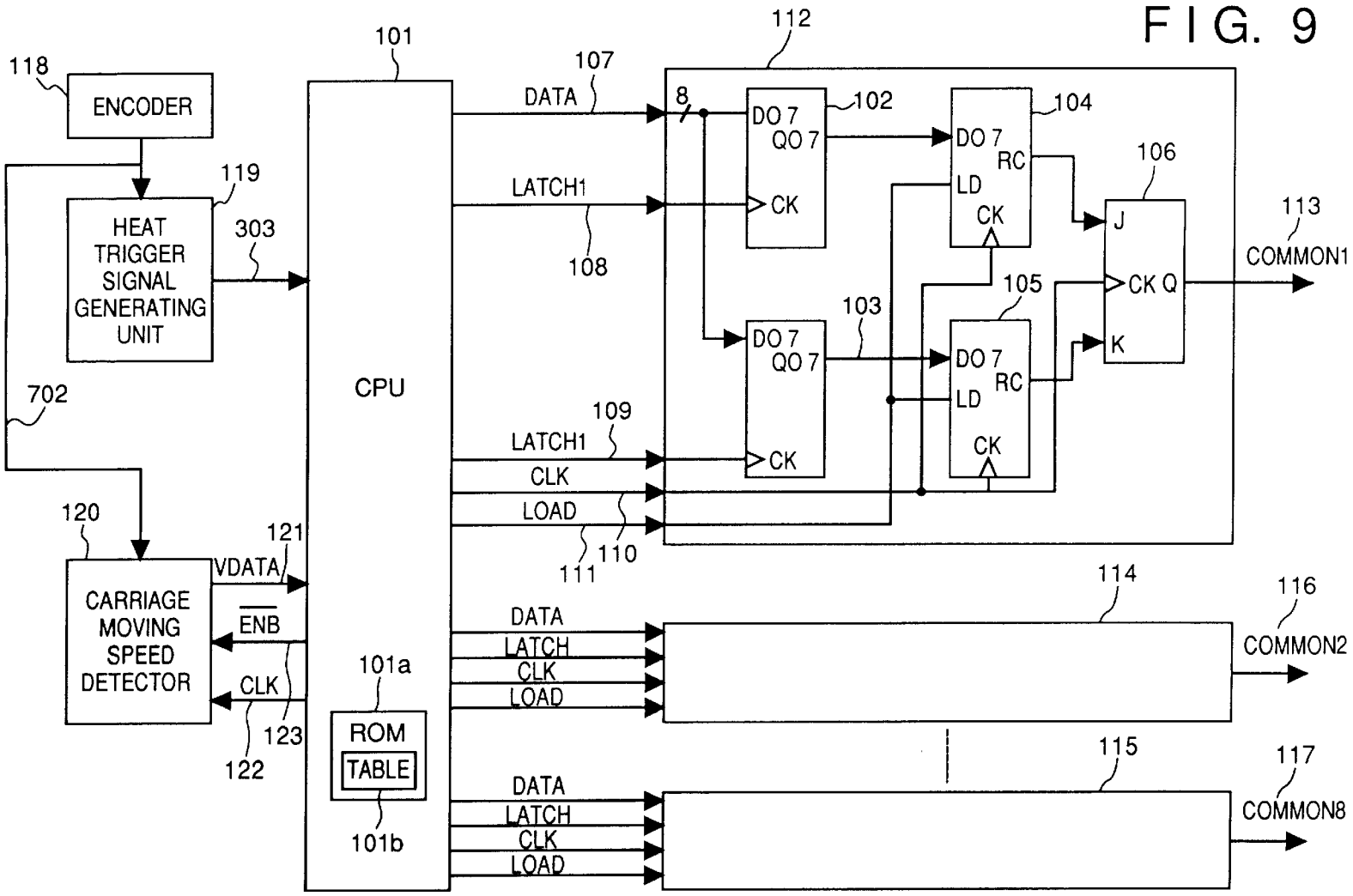
FIG. 9 is a block diagram illustrating the controller of the ink-jet printer of the fourth embodiment of the invention.
Figure 10:
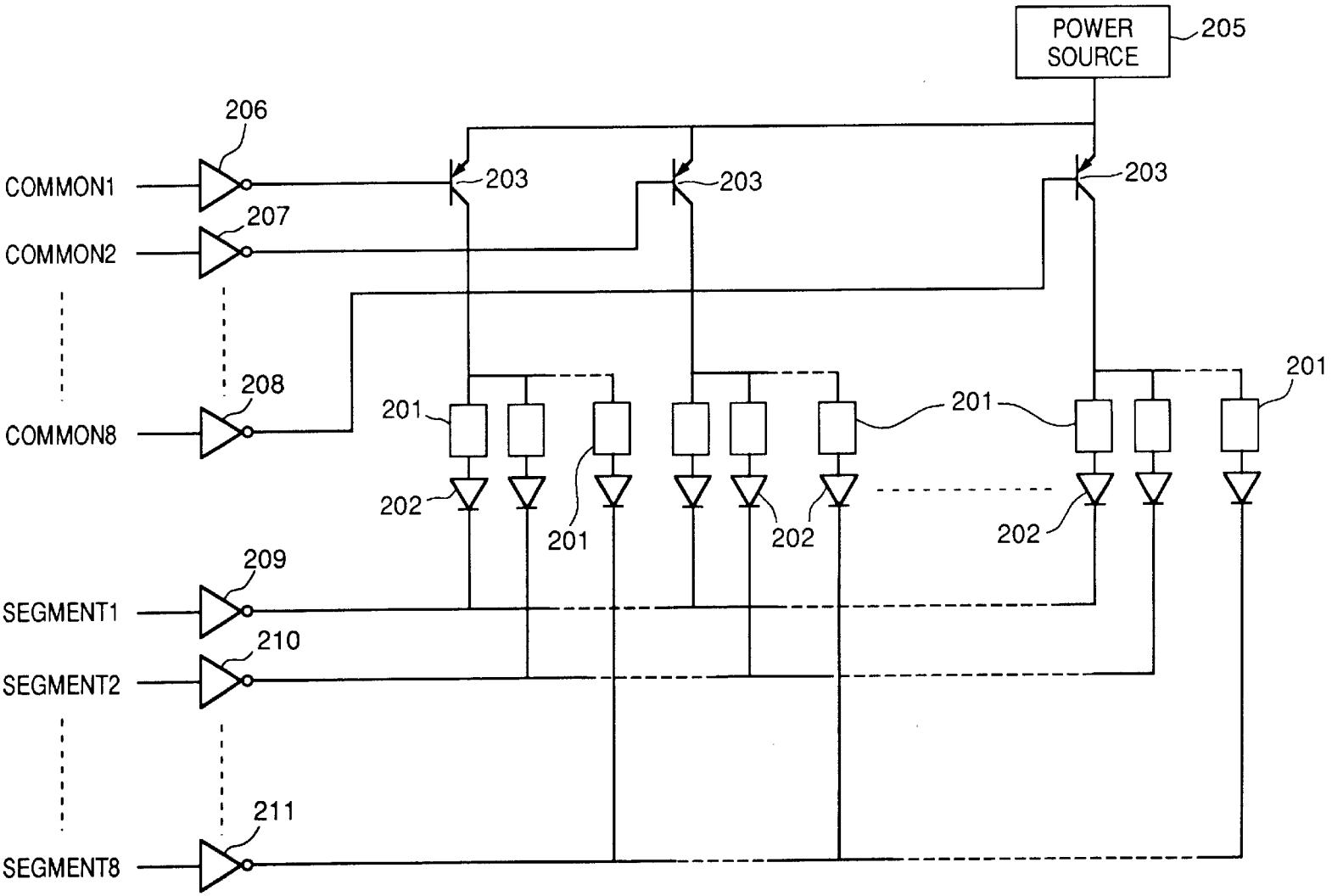
FIG. 10 is a diagram illustrating the ink-jet head of the fourth embodiment.

FIG. 9 is a block diagram illustrating the controller of the ink-jet printer of the fourth embodiment, and FIG. 10 is a model diagram illustrating the ink-jet head of the fourth embodiment.

In FIG. 10, numerals 201 are exothermic resistors which are used to generate a driving force to discharge an ink droplet from a corresponding nozzle of the head, by heating caused by electric current supply. Numerals 202 are diodes to prevent electricity flowing backward. The diode matrix is composed of 64 diodes. Eight exothermic resistors comprises a single block, and each block is connected to a COMMON signal. Furthermore, the terminal of the other side of each diode 202 is connected to a SEGMENT signal respectively, and the total number of the exothermic resistors in the head is 64. Numerals 203 are transistors which supply electric current to the eight exothermic resistors 201 in each block. Numeral 205 is a power source for head driving. Numerals 206, 207 and 208 are drivers of each transistor 203. Numerals 209, 210 and 211 are drivers of the SEGMENT signals.

FIGS. 11A–G is a diagram illustrating the driving timing of the ink-jet head shown in FIG. 10. The operation of the head is described in accordance with FIGS. 11A–G.

In the ink-jet head, printing is performed by discharging an ink droplet by supplying electricity to each exothermic resistor 201 switched on by each of the SEGMENT signals 307, 308 and 309.

Figure 11:
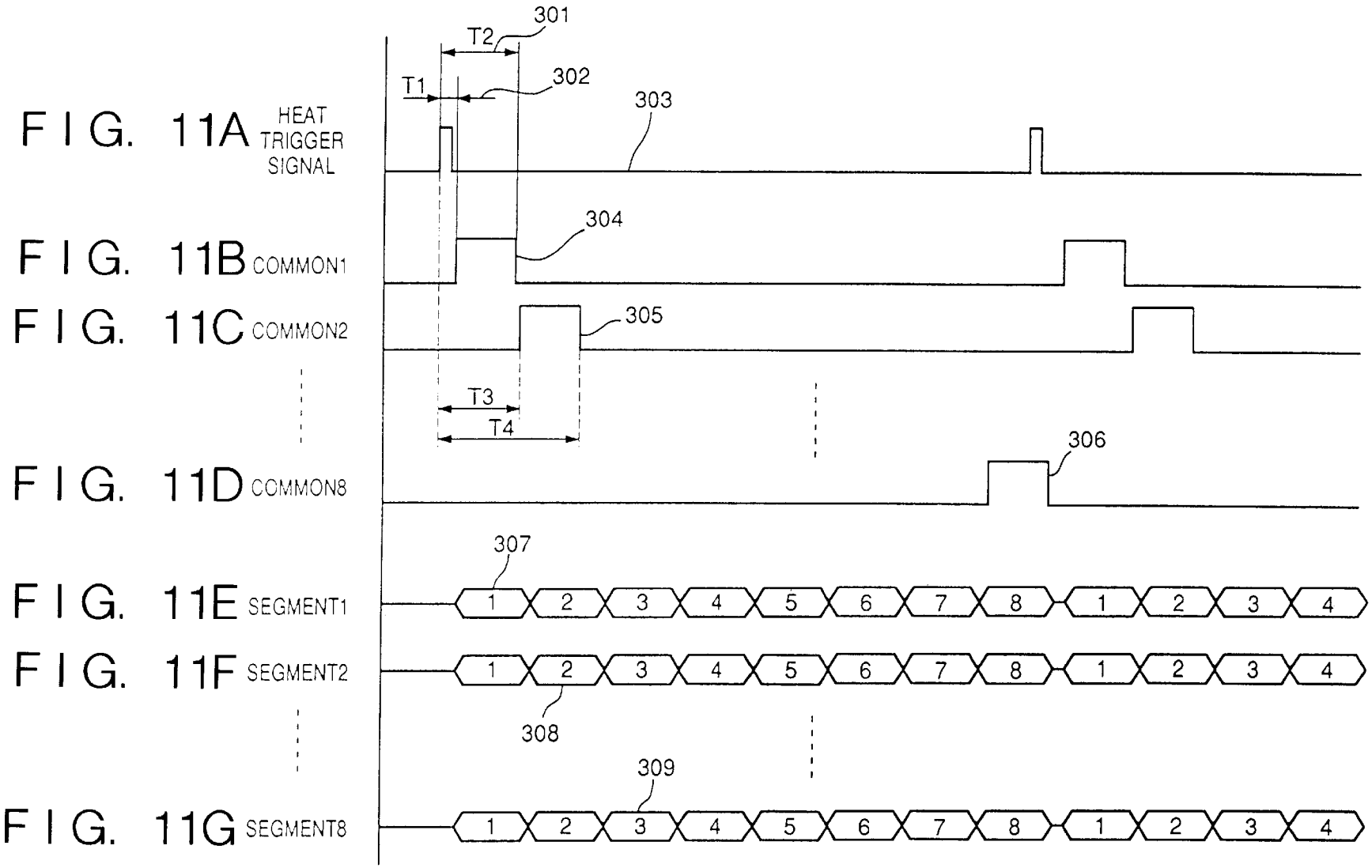
FIGS. 11A–11G comprise a heat timing chart of the ink-jet head of the fourth embodiment.

In FIG. 11, numeral 301 refers to a time period between when the time measuring is started and when the common signal 304 is turned on with respect to the heat trigger signal 303. This is realized by the latch circuit 102 and the counter 104 shown in FIG. 9. Numeral 301 (T2) refers to a pulse width of the COMMON signal 304. Furthermore, numerals 305 and 306 are second and eighth COMMON signals as similar to the COMMON signal 304. Furthermore, in FIG. 11, numerals 307, 308 and 309 refer to the first, second and eighth SEGMENT signals respectively, and each number on the SEGMENT signal indicates synchronism with the COMMON signals. If the SEGMENT signal corresponding to the COMMON signal is at a high level, the electric current flows to the corresponding exothermic resistor 201, and then the printing is performed by discharging ink droplets from the nozzles.

FIG. 9 is a diagram illustrating the characteristic of the fourth embodiment, and showing the main portions of the controller in the ink-jet printer in particular. Since the construction of the printer is the same as that of the previous embodiment, the description is omitted here. In this embodiment, the printing apparatus capable of performing a printing operation at the acceleration/deceleration of the carriage 2 is described.

In FIG. 9, numeral 101 is a CPU. Numerals 102 and 103 are latch circuits (registers) for holding timing data when a heat pulse of the head is generated. Numerals 104 and 105 are counters for outputting a timing signal which determines a pulse width of the COMMON signal in accordance with the data supplied from the latch circuit 102 or 103, respectively. Numeral 106 is a JK-type flip-flop for generating a heat pulse based on the output from the counters 104 and 105.

Numeral 107 is a data bus (DATA) for supplying the timing data to the latch circuits 102 and 103 from the CPU 101. Numerals 108 and 109 are latch signals (LATCH) for holding data in the latch circuits 102 and 103 respectively. Numeral 110 is a clock signal (CLK), and numeral 111 is a load signal (LOAD) for loading the timing data from the latch circuits 102 and 103 to the counters 104 and 105. Numeral 113 is one of the heat pulse signals, a COMMON 1 signal, which are outputted to the ink-jet head 1. Numeral 112 is a circuit block having the above structure, numerals 114 and 115 are also the circuit blocks which have the same structure as that of the circuit block 112. As a total, circuits for eight blocks are provided. Note that structures of heat pulse generation circuit blocks 114 and 115 are not shown, because they are the same as the structure of the circuit block 112. Furthermore, numerals 116 and 117 are output signals (COMMON signals) from the heat pulse generation circuit blocks.

Numeral 118 is an encoder for timing to print, which corresponds to the encoder film 6 as described before. As this type of encoder, in addition to the above-described encoder, there is a rotary type encoder which is mounted on the carriage motor 4 or a linear type encoder which directly detects the movement of the carriage 2. Numeral 119 is a heat trigger signal generation unit for generating a heat trigger signal 303 indicating the print timing based on the encoder signal 702 of the encoder 118. This heat trigger signal 303 is inputted into the CPU 101. Numeral 120 is a carriage moving speed detector for detecting a moving speed of the carriage 2, numeral 121 is a data line (VDATA) for supplying a result (moving speed data) to the CPU 102, and numeral 122 is a CLK signal line for supplying a clock signal (CLK) to the carriage moving speed detector 120. Numeral 123 is an enable signal (ENB) which is outputted so that the CPU 101 receives the result from the carriage moving speed detector 120. When the enable signal is active (at low level), data (VDATA) is outputted to the data line 121 and received by the CPU 101.

The operation is described with reference to the figure.

The slit of the encoder 118 is set in accordance with the density of dots to be printed. The encoder 118 outputs a pulse signal corresponding to the dot density (in general, 180 dots/inch or 360 dots/inch) from the encoder 118 in accordance with the movement of the carriage 2 when the carriage motor 4 is rotated. The pulse signal is inputted into the heat trigger signal generation unit 119 and the carriage moving speed detector 120, and a heat trigger signal 303 is outputted from the heat trigger signal generation unit 119 by the pulse signal.

The CPU 101 supplies parameter values required for generating a COMMON signal for printing to the latch circuits 102 and 103 via the data line 107. The latch circuits 102 and 103 are provided with the values respectively corresponding to T1 timing 301 and T2 timing 302 of FIG. 11. That is, printing in the main scanning direction can be performed at a constant dot pitch, by setting appropriate values in the latch circuits 102 and 103 in accordance with the moving speed of the carriage 2. That is, clock signals are constantly inputted into the clock terminals of counters 104 and 105, and the clock terminal CK of the JK flip-flop 106. When the value of the counter 104 is counted down and a ripple carry (RC) signal is outputted (when T1 is clocked), the JK flip-flop 106 is set, and the COMMON signal 1 becomes high level (at the rise of the COMMON signal 1), while when the counter 105 is counted down and a ripple carry signal is outputted (when T2 is clocked), a k input of the JK flip-flop 106 becomes high level and the flip-flop 106 is reset. Accordingly, the COMMON signal 1 is fallen. This operation is performed in the circuits 114 and 115 as well as in the circuit 112.

Furthermore, the parameter values set in the latch circuits 102 and 103 by the CPU 101 are unconditionally calculated from the moving speed of the carriage 2 in the case of movement at the constant speed such as high-speed printing. While in the case of acceleration/deceleration area of the carriage 2, the parameter values are determined by sequentially detecting the moving speed of the carriage 2 by the carriage moving speed detector 120.

An example of the calculation method is described below. In general, an acceleration/deceleration of the carriage 2 is performed in accordance with a predetermined acceleration/deceleration curve (in general, defined by a 1-dimensional straight line, graph or 2-dimensional curve). If the speed of the carriage 2 at a certain point is detected, the moving speed of the carriage 2 to the next print timing can be estimated. Accordingly, the parameter values can be calculated in accordance with the estimated moving speed.

When the data is loaded to the counters 104 and 105 by the LOAD signal 111, the counters 104 and 105 start to count down in synchronism with the CLK signal. Subsequently, the output (RC) from the counters 104 and 105 and the JK flip-flop 106 generate a COMMON 1 signal. In setting of the parameter values, LATCH 1 signals 108 and 109 are used, while in counting and set/reset of the flip-flop 106, CLK signal 110 is used.

Figure 12:
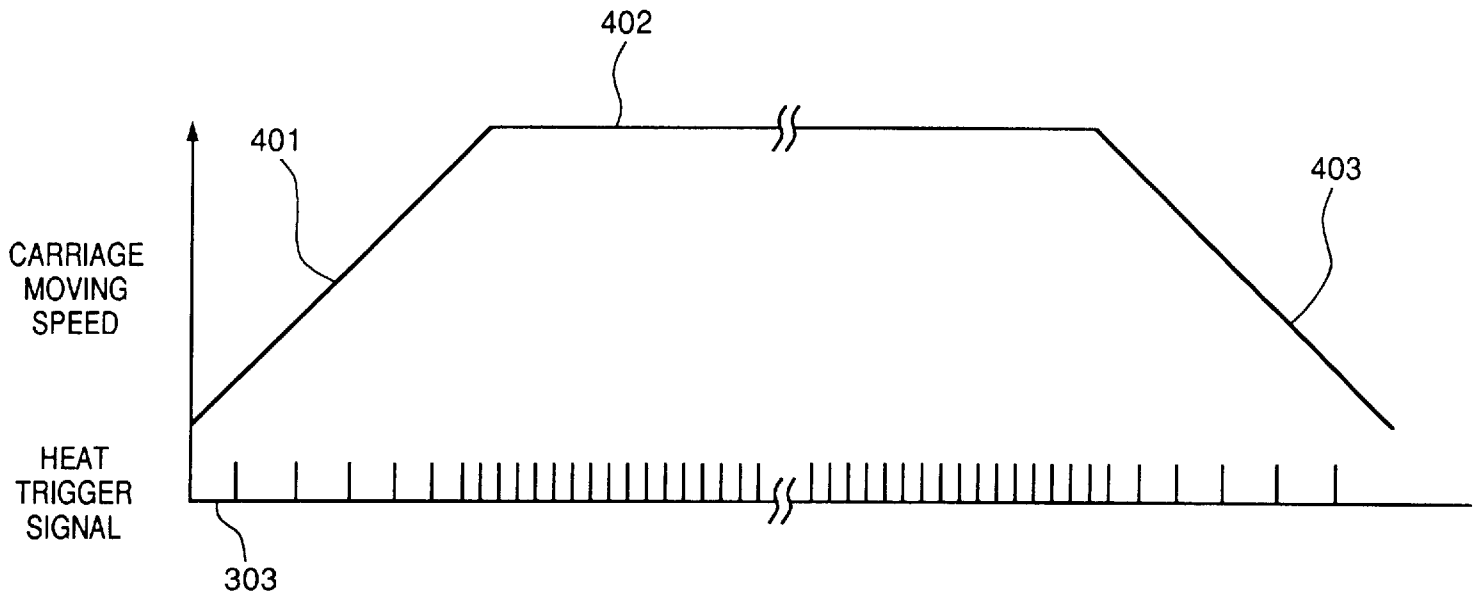
FIG. 12 is a diagram showing the relationship between the carriage moving speed and heat timing signal.
Figures 13A, 13B, 13C, 13D:
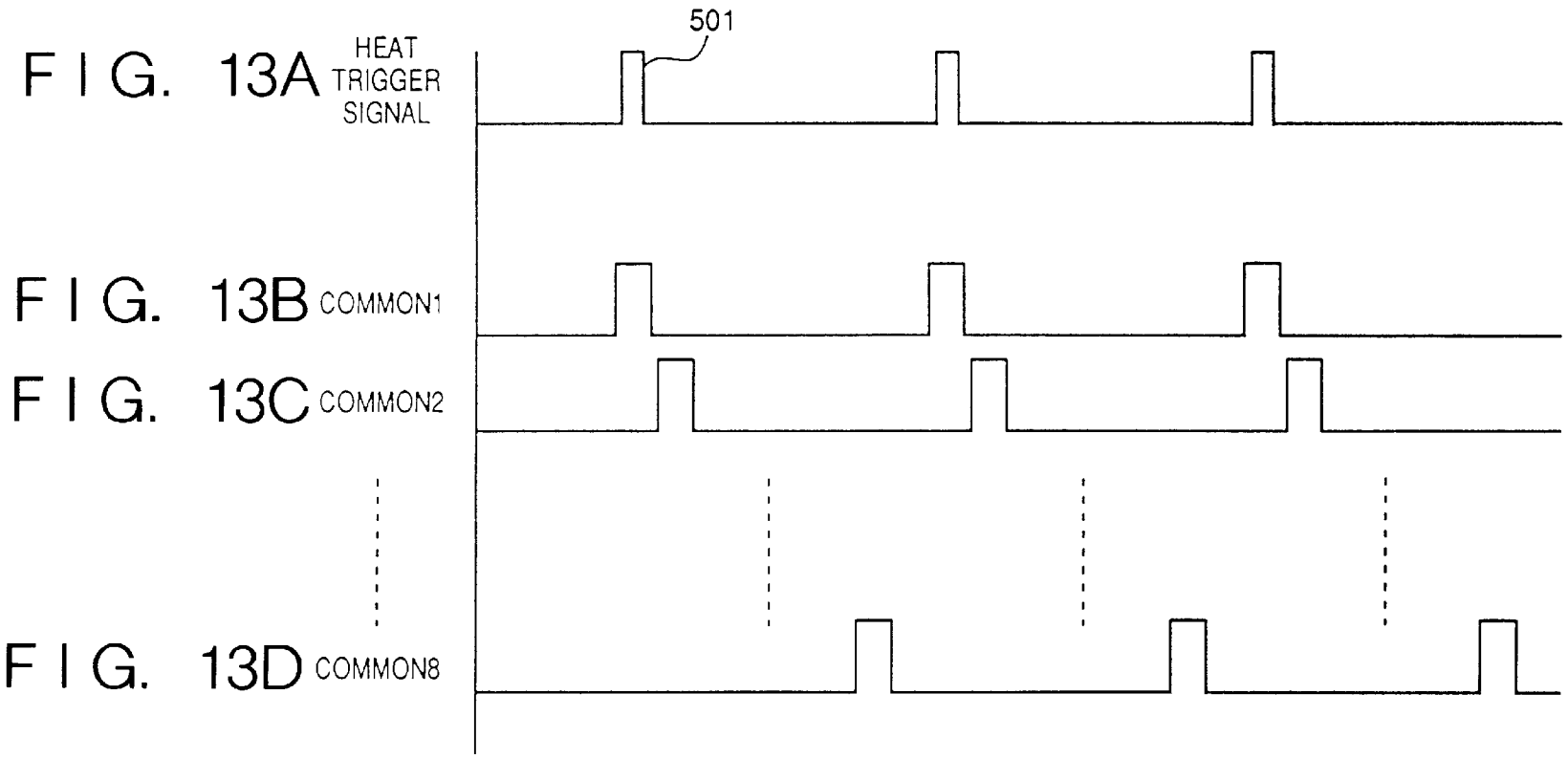
FIGS. 13A–13D comprise a diagram illustrating the heat timing of the ink-jet head when the carriage moving speed is at a constant speed.
Figures 14A, 14B, 14C, 14D:
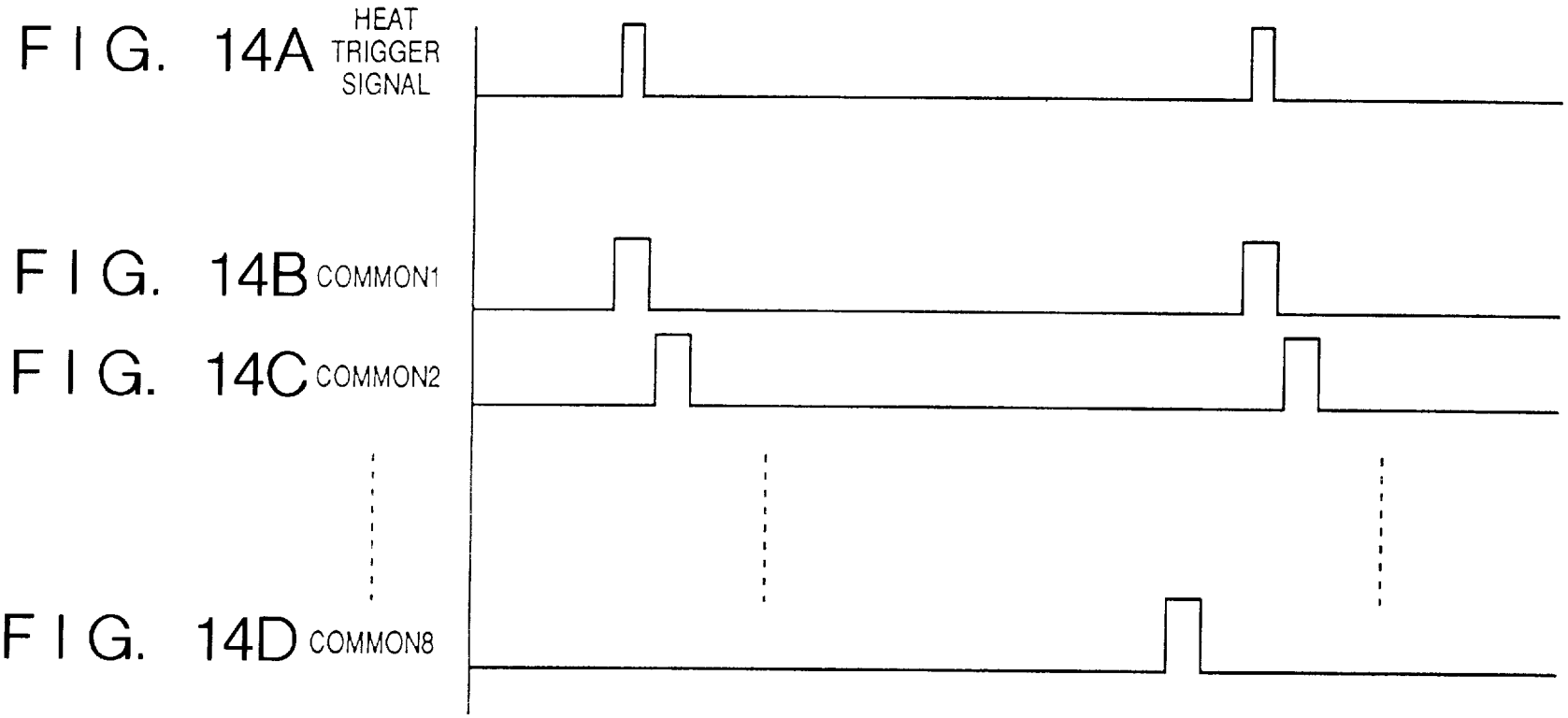
FIGS. 14A–14D comprise a diagram illustrating the heat timing of the ink-jet head when the carriage moving speed is accelerated/decelerated.

FIGS. 12–15 are model diagrams illustrating the operation of the embodiment. FIG. 12 shows the state where the intervals of the heat trigger signals 303 (the output signals of the encoder 118) are changed in accordance with the moving speed of the carriage 2. In FIG. 12, numeral 401 refers to an acceleration area of the carriage 2 (carriage motor 4), numeral 402 refers to a constant speed area, and numeral 403 is a deceleration area.

FIGS. 13A–D comprise a timing chart of the heat trigger signal 501 and COMMON signal in the constant speed area 402 of FIG. 12. FIGS. 14A–D comprise a timing chart of the heat trigger signal and COMMON signal in the acceleration area 401 and the deceleration area 402. As apparent from FIG. 12, the interval of the heat trigger signal is decreased in the constant speed area 402, and the moving speed of the carriage 2 is fast. In the acceleration area 401 and the deceleration area 402, the interval of the heat trigger signal lengthens because the moving speed of the carriage 2 is decreased.

Furthermore, the pulse width of the COMMON signal is constant regardless of the moving speed of the carriage 2, and the output interval of the COMMON signal lengthens in FIG. 14. As a result, the dot pitch to be printed is constant regardless of the speed of the carriage 2.

Figure 15:
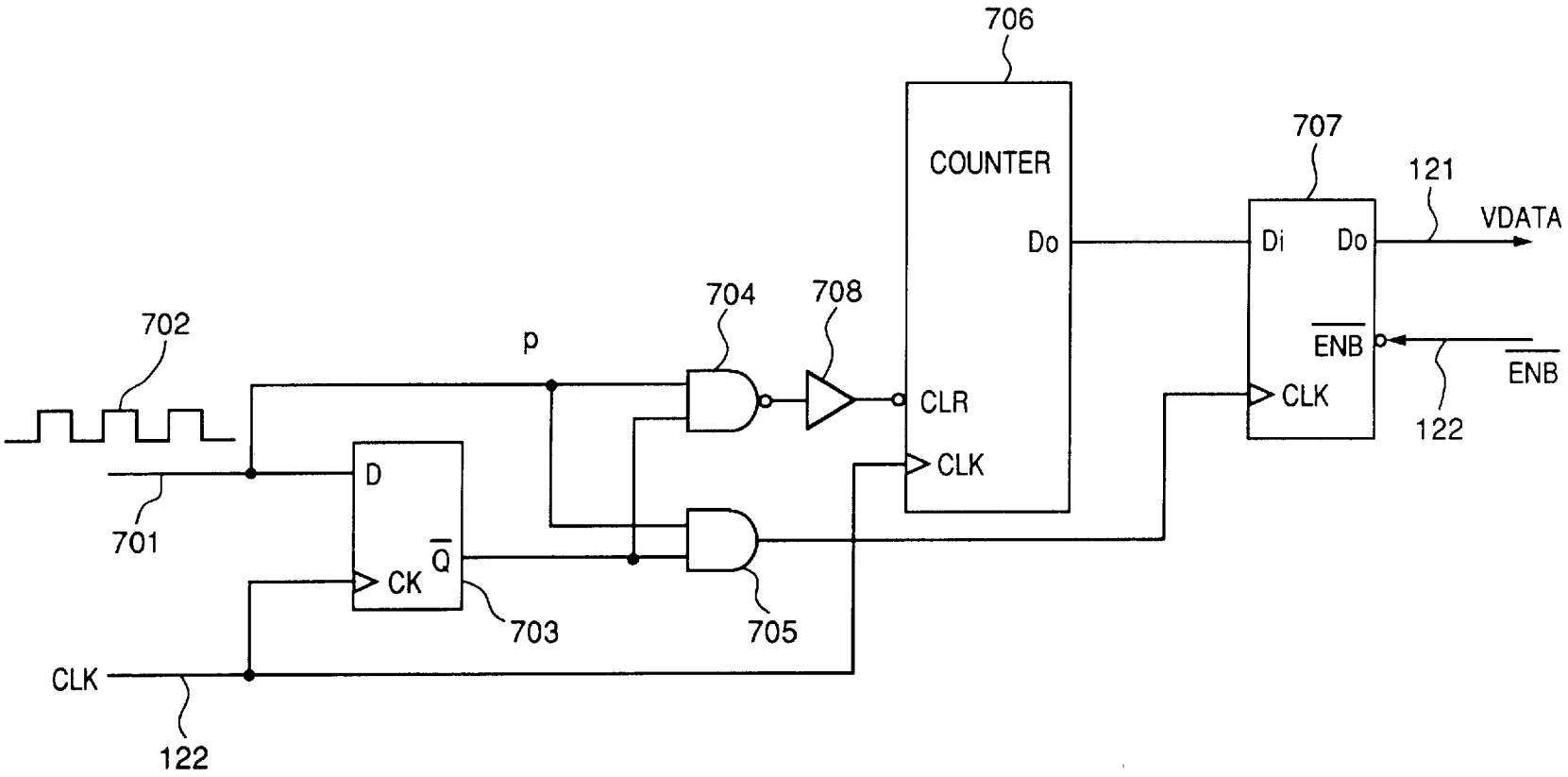
FIG. 15 is a diagram illustrating the circuit of the carriage moving speed detector of the fourth embodiment.

FIG. 15 is a diagram illustrating an example of the circuit of the carriage moving speed detector 120 shown in FIG. 9. The frequency of the clock signal (CLK) 122 is higher than that of the signal from the encoder 118.

In the figure, numeral 701 is a signal input line of the encoder 118, and numeral 702 refers to a signal which is supplied to the encoder signal input line 701. Numeral 703 is a D-type flip-flop, numerals 704 and 705 are AND gates comprising a differentiating circuit which detects a leading edge of the encoder signal 702, numeral 706 is a counter for measuring the interval of the leading edge of the encoder signal 702 (the pulse interval of the signal 702), and numeral 707 is a latch for temporary holding the result.

The operation is described with reference to FIG. 15. When the leading edge of the encoder signal 702 is inputted into the flip flop 703, the output of the NAND gate 704 becomes low level instantly, and clears the counter 706. Subsequently, the counter 706 is counted up in synchronism with the CLK signal 122 until the leading edge of the next pulse is inputted. As described earlier, when the next pulse is inputted, the counter 706 is cleared. At the same time, the count value at that time is held by the latch circuit 707 by the output of the AND gate 705. The data held in the latch circuit 707 is outputted and received by the CPU 101 via the DATA line 121 by the instruction of an enable (ENB) signal 123. Numeral 708 is a buffer for signal delay.

Since the frequency of the CLK signal 122 is fixed, a value corresponding to the moving speed of the carriage 2 is set in the latch circuit 707. That is, if the moving speed decreases, the value set in the latch circuit 707 increases, while if the moving speed increases, the value decreases. The CPU 101 includes a table 101*b* (stored in the ROM 101*a*) which stores set values of time T1 and time T2 corresponding to the values (VDATA) inputted from the detector 120. With reference to the table 101*b*, the CPU 101 obtains values to set in the latch circuits 102 and 103 based on the values received from the detector 120, sets the values in the latch circuits 102 and 103, and determines an output timing T1 of the COMMON 1 signal to the heat trigger signal 303 and a trailing edge of the COMMON 1 signal.

Figure 16:
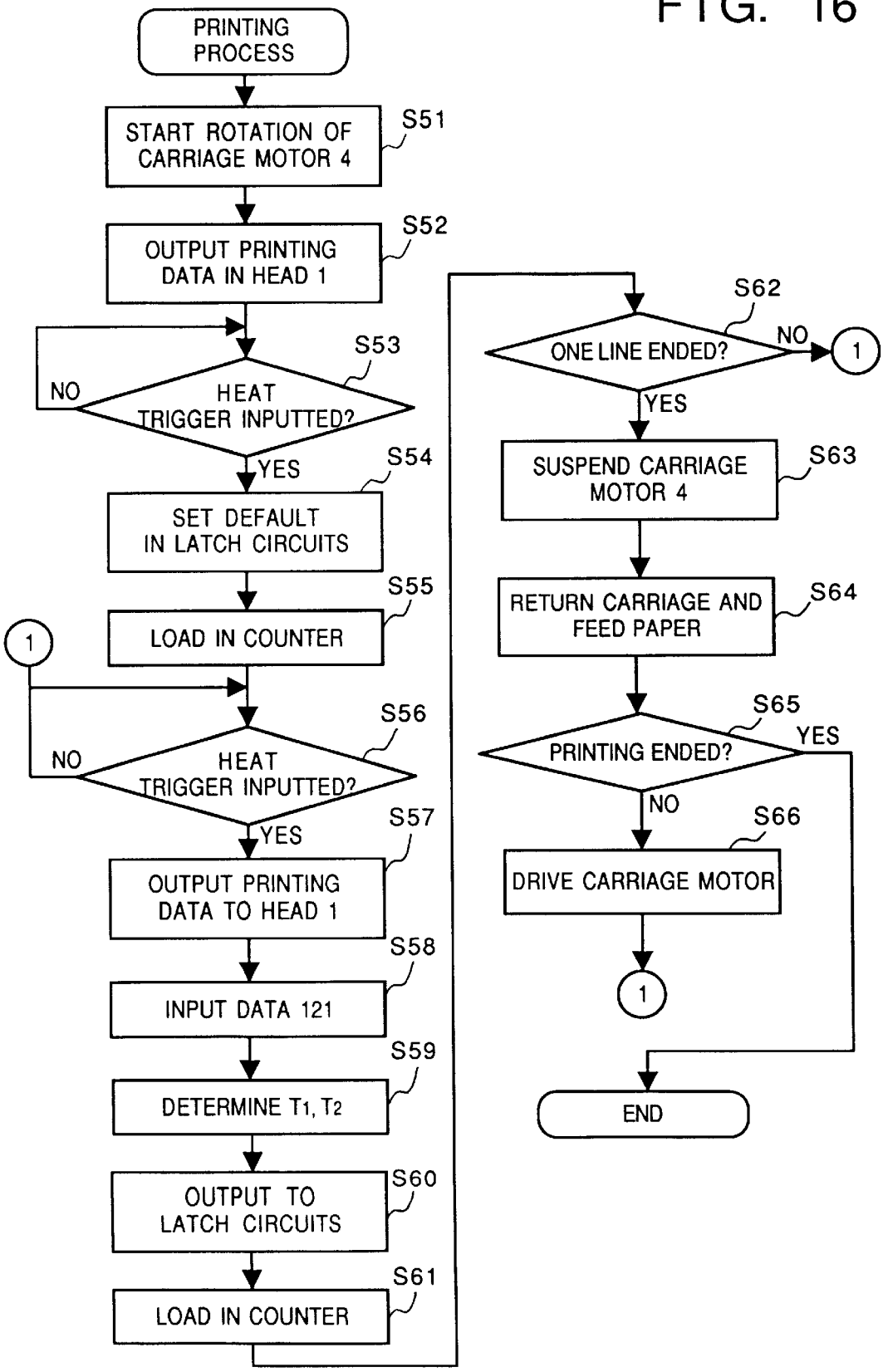
FIG. 16 is a flowchart illustrating the printing process of the central processing unit in the fourth embodiment.

The operation of the CPU 101 is described below with reference to the flowchart of FIG. 16. The control program which executes this processing is stored in the ROM 101*a*.

This processing is started by the instruction of the printing operation. First, at step S51, the rotation of the carriage motor 4 is started, and the carriage 2 is moved. Subsequently, the process proceeds to step S52 where printing data is outputted to the head 1 as a segment signal. The process proceeds to step S53 where it is waited until a heat trigger signal 303 is inputted. When the heat trigger signal 303 is inputted, the process proceeds to step S54 where default values are respectively set in the latch circuits 112, 114, 115, . . . (corresponding to 102 and 103). At step S55, load signals (LOAD) 111 are outputted, and loaded to each counter (corresponding to 104 and 105). Accordingly, with synchronism with the signal 702 from the encoder 118, printing is performed when the eight blocks of the head 1 are driven in the timing shown in FIGS. 13 and 14.

Accordingly, when the leading dot of the line is printed, the process proceeds to step S56 where it is waited for the heat trigger signal 303 to be inputted, the next print timing. When the trigger signal 303 is inputted, the process proceeds to step S57 where the printing data is outputted as a segment signal of the head 1. At step S58, the data (VDATA) 121 is inputted from the carriage moving speed detector 120, timing information of T1, T2 (FIG. 11) which are set in the latch circuits (such as 102, 103) of the circuit blocks 112–115 are based on the data 121. The raise/fall timing of other COMMON signals are determined based on the timing information. Furthermore, data to determine the above timings is obtained with reference to the table 101*b*.

The data which determines the timings are outputted to and held in the latch circuits 112, 114, 115, . . . , and held (step S60), and loaded to the corresponding counters (104, 105) (step S61). Accordingly, the printing is performed at the timing shown in FIGS. 13 and 14 in accordance with the printing data outputted at step S58.

In this case, as shown in FIG. 11, each of the latch circuit of the circuit block 114 is set with the time values corresponding to T3, T4. Similarly, the latch circuits of another circuit block are set with the time value corresponding to the output timing of each COMMON signal.

Subsequently, the process proceeds to step S62 where whether or not the printing process of one line is ended is determined. If not, the process returns to step S56 where the above-described process is executed. If ended, the process proceeds to step S63 where the movement of the carriage 2 is suspended. At step S64, a carriage return and paper transfer are performed, and at step S65, whether or not an entire printing process has ended is determined. If ended, the processing ends, while if not, the process proceeds to step S66 where the movement of the carriage 2 is started. The process then proceeds to step S56 where the printing process of the next line is started.

In the embodiments, an ink-jet printer is described as an example, however, this does not impose a limitation upon the invention. The present invention is applicable to various types of printers if a printing head and a recording medium are moved relatively to each other.

Furthermore, in the embodiments, a serial-type inkjet printer is described as an example, however, this does not impose a limitation upon the invention. For example, the present invention is applicable to a printing apparatus capable of printing by dividing exothermic elements of a thermal head into groups such as a line-type thermal head.

In the present embodiment, the linear encoder is a photo-electric encoder, but the invention is not limited to the photo-electric encoder, and the encoder may be a magnetic encoder.

Furthermore, the heat trigger signal can be obtained not only by using the encoder, but also by using an internal clock in the system as in the first embodiment.

Furthermore, in the fourth embodiment, the heat pulse generation circuit is comprised of a latch circuit, counter and flip-flop. However, this does not impose a limitation upon the invention, for the heat pulse generation circuit can be comprised of a counter and comparator.

In the embodiments, a single color printer is described as an example, however, this does not impose a limitation upon the invention. For example, the invention is applicable to a color printer having a plurality of printing heads (generally, a few printing heads).

As described in the fourth embodiment, printing without shift in a ruled mark is performed at a high speed by setting a timing of heat pulse generation in accordance with the carriage moving speed. Furthermore, with the above construction, printing becomes possible when the carriage 2 is accelerated/decelerated. Accordingly, the area for acceleration and deceleration is used for printing, therefore, the apparatus is minimized in size to print the same length as in the conventional printing apparatus.

Each embodiment is described separately, however, each embodiment can be combined.

The present invention can be applied to a system constituted by a plurality of devices, or to an apparatus comprising a single device. Furthermore, it goes without saying that the invention is applicable also to a case where the object of the invention is attained by supplying a program to a system or apparatus.

As described above, according to the embodiments, recording is performed by the printing head in an area other than the area where the carriage motor is moved at a constant speed, and a compact recording apparatus can be provided. According to the present invention, printing can be performed by the printing head in an area other than the area where the carriage motor is moved at a constant speed, thus the printing apparatus can be reduced in size.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus which performs printing by moving a printing head, having a plurality of printing elements, relative to a printing medium, said apparatus comprising:

scanning means for moving the printing head over the printing medium so as to perform the printing, said scanning means accelerating the printing head to a predetermined speed in an accelerating speed area, moving the printing head at the predetermined speed in a constant speed area and decelerating the printing head from the predetermined speed in a decelerating speed area;

detection means for detecting the speed of the printing head relative to the printing medium in the accelerating speed area, constant speed area and decelerating speed area;

timing determination means for determining a timing to drive the printing head in accordance with the speed detected by said detection means; and printing means for printing by driving the printing head in accordance with the timing determined by said timing determination means, the printing head being enabled for driving in the accelerating speed area, the constant speed area and the decelerating speed area, wherein said printing means divides the plurality of printing elements into a plurality of blocks and sequentially drives each of the plurality of blocks of the printing elements in a driving period, and said timing determination means determines driving timing of each of the plurality of blocks of the printing elements and changes time intervals between the driving timing of each of the plurality of blocks of the printing elements in the driving period in accordance with the speed of the printing head detected by said detection means, each of the time intervals between the driving timings in the accelerating speed area and the decelerating speed area being longer than each of the time intervals in the constant speed area, and a driving period of each of the plurality of blocks of the printing elements is constant in each of the accelerating speed area, the constant speed area and the decelerating area.

2. The apparatus according to claim 1, wherein said detection means detects the speed of the printing head by detecting that the printing head passes a slit of an encoder provided in a scanning area.

3. A printing apparatus according to claim 1, wherein said detection means comprises a scale having a plurality of slits formed in a predetermined pitch and a sensor for detecting each of said plurality of slits on the scale, and said detection means detects the speed of the printing head in accordance with a detection of each of said plurality of slits by said sensor which is moving with the printing head.

4. A printing apparatus according to claim 1, wherein said timing determination means comprises storage means for prestoring timing data concerning a driving timing of the printing head, the timing data being defined to conform the driving timing of the printing head to the speed of the printing head, and said timing determination means reads the timing data from the storage means and said printing means drives the printing head at a printing timing in accordance with the timing data.

5. A printing apparatus according to claim 1, wherein the printing head comprises an ink jet printing head including electrothermal transducers for heating and ejecting ink.

6. A printing apparatus according to claim 1, wherein the printing head comprises plural printing units, each of the plurality of printing units for printing with a different color.

7. A printing apparatus according to claim 6, wherein each of the plurality of printing units comprises an ink jet printing unit including electrothermal transducers for heating and ejecting ink.

* * * * *